US005775948A

United States Patent [19]

Madeley

[11] Patent Number: 5,775,948

[45] Date of Patent: Jul. 7, 1998

[54] ELECTRICAL CONNECTOR

[75] Inventor: John Nigel Madeley, Worksop, United Kingdom

[73] Assignee: Cinch Connectors Ltd., Carlton-In Lindrick, United Kingdom

[21] Appl. No.: 686,940

[22] Filed: Jul. 26, 1996

[30] Foreign Application Priority Data

Aug. 28, 1995 [GB] United Kingdom ..... 9515507

[51] Int. Cl.[6] ..... H01R 9/03

[52] U.S. Cl. ..... 439/610; 439/931

[58] Field of Search ..... 439/610, 931

[56] References Cited

U.S. PATENT DOCUMENTS

| | | | |
|---|---|---|---|
| 4,433,206 | 2/1984 | Lewis | 439/610 |
| 4,517,740 | 5/1985 | Dyce et al. | 29/857 |
| 5,244,415 | 9/1993 | Marsilio et al. | 439/610 |
| 5,399,808 | 3/1995 | Carter et al. | 439/610 |

FOREIGN PATENT DOCUMENTS

| | | | |
|---|---|---|---|
| 3439931 | 5/1986 | Germany | 439/610 |
| 2160718 | 12/1985 | United Kingdom . | |
| 2199198 | 6/1988 | United Kingdom . | |
| 9428601 | 12/1994 | WIPO . | |

*Primary Examiner*—Gary F. Paumen

*Attorney, Agent, or Firm*—Watson Cole Grindle Watson, P.L.L.C.

[57] ABSTRACT

A connector unit is provided with a connector part which interfaces with another connector and a back shell. The back shell is split into two sections, the first of which attaches to the connector part. Once wires have been soldered to the connector part. The first back shell section is connected and the resulting cavity filled with resin. The second back shell section is attached to the first first back shell section and a conductive shielding layer is electrically connected close to the interface of the two back shell sections. The cavity generated by the second back shell section is then filled with resin, and the connector unit is sealed.

16 Claims, 4 Drawing Sheets

ELECTRICAL CONNECTOR

BACKGROUND OF THE INVENTION

The present invention relates to electrical connectors and more particularly to the outer shells of the connectors.

Many pieces of modern electrical equipment are now connected together using multi-way connectors in view of the need to couple a considerable number of wires. Various standard systems have been utilized in the past e.g. D-type connectors, to specify the size shape and spacing of the pins and sockets of a plug and socket connector There is often a requirement that the connectors should be as small as possible and this has put considerable constraints on the ability of assemblers to actually physically make connection between the wires of a cable and the pins or sockets of a connector part. The problems are exacerbated if the connector has to be suitable for use in a hostile environment or where it may be subjected to substantial amounts of electromagnetic interference (EMI).

SUMMARY OF THE INVENTION

The present invention is intended to provide a connector shell which is suitable for producing a connector intended to be utilized in a hostile environment and in the presence of EMI. This is achieved by producing a shell from a conductive material the shell having a main portion surrounding the connection between the wires and the pins or sockets of the connector and a tubular extension portion also of conductive material for attachment to the main body portion to permit connection to be made between the main body portion and screening wires of a cable to be attached to the connector.

The main body portion may be a single unitary portion or may be constructed from two mating main portion parts. Also, the main body portion may be a straight tubular section or turn through an angle of up to 90°.

In order that the present invention may be more readily understood, embodiments thereof will now be described by way of example with reference to the accompanying drawings:

DESCRIPTION OF THE INVENTION

Figure 1:
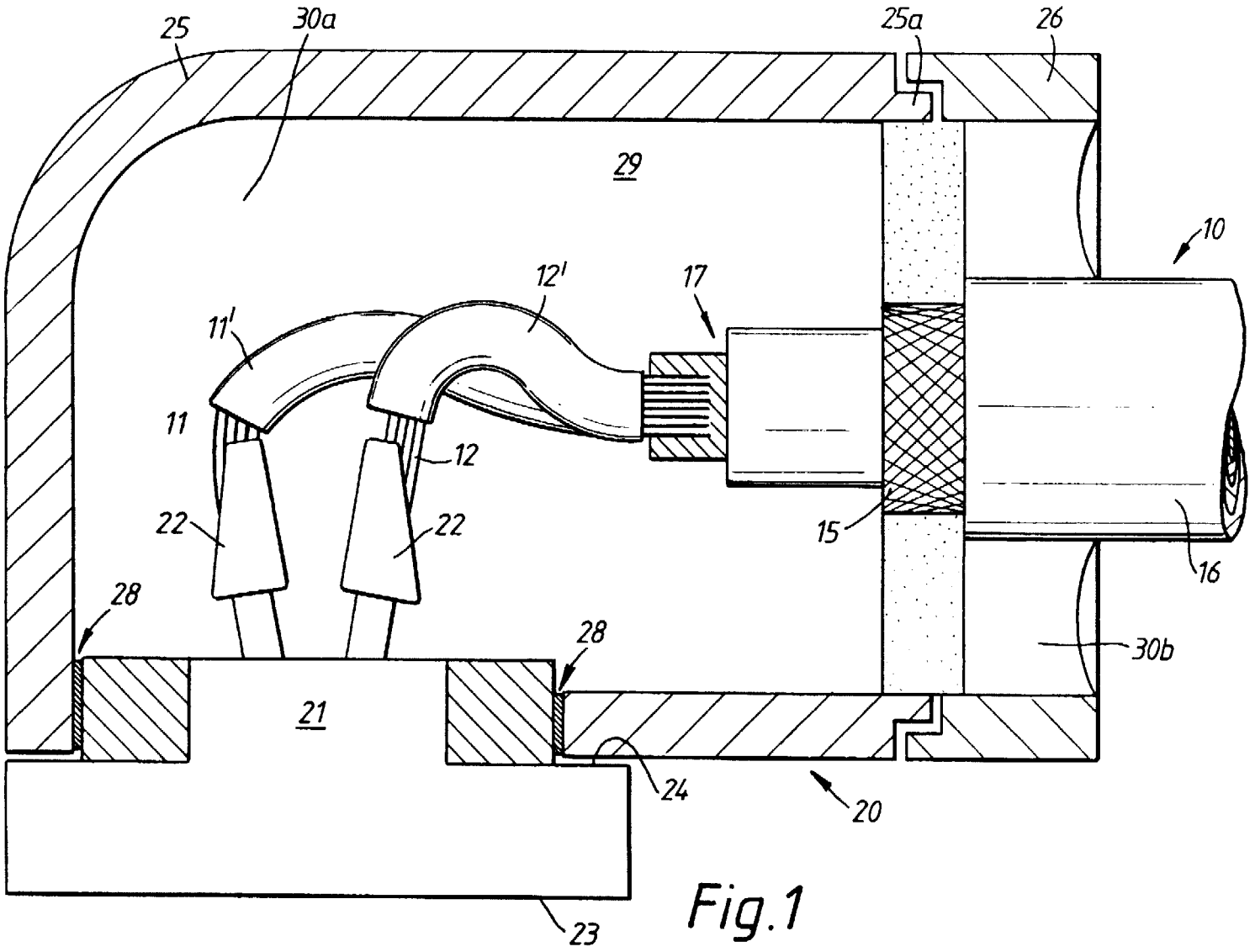
FIG. 1 is a diagrammatic sectional side view through a connector using a back shell according to the present invention.

When providing wiring and connectors for use in hostile environments, it is common for the wiring to be protected by means of a conductive braid extending around the signal wires themselves but insulated therefrom. The braid provides mechanical security for the wiring, i.e. it protects the wiring from cuts and knocks, but it also provides electromagnetic screening if the wire braid is grounded A major difficulty with such wiring is that it is much more inflexible than normal wiring. This inflexibility is compounded if it is desired to only expose the actual signal carrying wires over a short length to enable them to be connected to the pins or sockets of a connector. This difficulty is further compounded if the overall size of the connector has to be restricted because this brings the metal braid much closer to the exposed wires than is convenient for easy connection of the wires themselves. The problem is even further exacerbated if it is desired to fill any voids in the connector with insulating material as is often the case when producing connectors attached to wires for use in hostile environments where ingress of water or water vapour has to be prevented if at all possible.

The embodiments to be described subsequently, reduce these difficulties as much as possible by splitting the back shell of the casing of the connector into two portions when viewed along the length of the cable to be attached. The main portion of the back shell is used for enclosing the normal connections from the pins or sockets of the connector to the wires and the voids which result after such connection are then filled with an insulative material. It is a property of such insulative material that a distinctive meniscus is formed which extends up to the level of the perimeter of the opening in the back shell main body portion. The further portion of the back shell can then be slipped down the wiring to mate with the main body portion and provide a pre-determined length of back shell to which the protective braid of the wiring can be conductively coupled by means of a suitable bonding material or a suitable mechanical bond. The further back shell portion will have an axial extent sufficient to provide an additional space which can then be filled with insulative material to protect the conductive bond.

In this way, the total axial length of the conductive back shell can be reduced while still ensuring an adequate conductive connection between the braid and the back shell to provide appropriate EMI screening.

Depending on the number of conductors in the wiring and/or the exact shape of the back shell and/or the cable, it may be necessary to split the main portion of the back shell in an axial direction to provide two mating portions which can be electrically conductively connected together by means of a suitable bonding material or mechanical connection.

In any event, the back shell will be conductively connected to the connector itself whereby to ensure proper electrically screening to ground.

Turning now to FIG. 1, this shows a diagrammatic sectional side view of a connector according to the present invention attached to the end of a cable.

As shown in FIG. 1, the cable 10 is a multi-strand, i.e. multi-wire cable but only two wires 11 and 12 are shown Each wire is covered in a insulative material which for the two wires shown are indicated as reference numerals 11' and 12'. The cable is provided with a wire braid 15 and the outer surface of the cable is formed by an insulative sleeve 16. If necessary, additional braiding and additional insulative sleeving, can be provided depending on the exact requirements for the cable. This additional screening . and insulation is generally indicated by the reference numeral 17.

The connector is generally shown by reference numeral 20 and comprises three parts, namely a main connector portion 21 provided with a plurality of pins or sockets 22 to which the wires 11,12 are connected. A main back shell part 25 and a further back shell part or extension 26. The main connector portion 21 is designed to mate with a corresponding connector part on another piece of equipment or another cable and is largely conventional. Consequently, no further detailed description of the portion 21 will be given except to say that it is made of or provided with a conductive shell to permit grounding of the portion 21. The portion 21 has a mating surface 23 and a back surface 24. Attached to the back surface 24 is the main back shell body part 25 and a further back shell part 26 attached to the main back shell part as will be described in more detail later.

For the purposes of the present description, it is assumed that the main back shell part 25 and the further back shell part 26 are both generally tubular. By the expression tubular we do not necessarily mean that they are of circular cross-sectional shape The word tubular is being used to indicate a hollow body whose cross-section can be any suitable shape.

Figure 2:
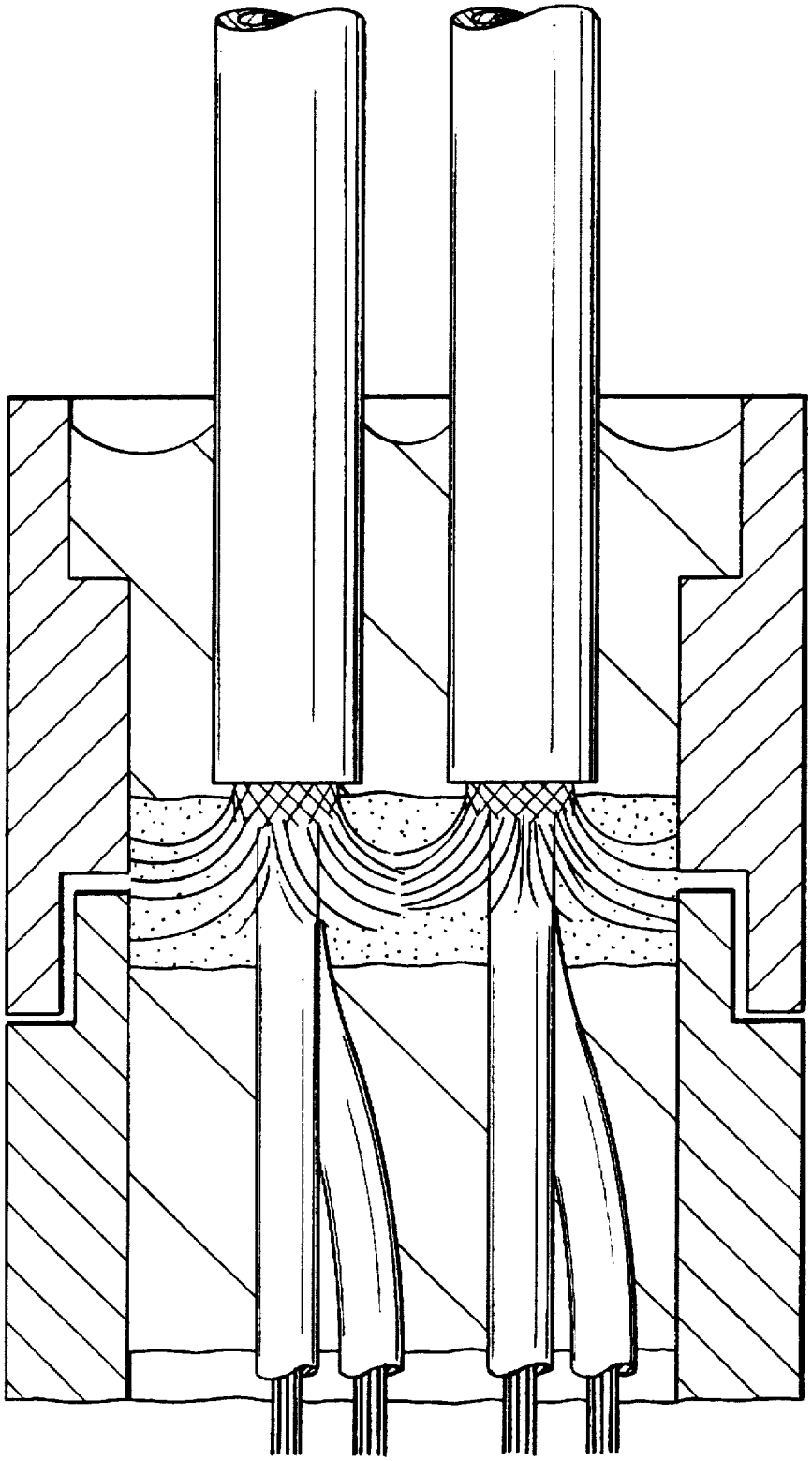
FIG. 2 is a diagrammatic sectional side view of a part of the connector back shell shown in FIG. 1.

In order to understand how the back shell parts are connected together and connected in turn to the main connector part 21, it is thought better to describe the method of connection. It is assumed that as a preliminary to connection, the cable 10 has been prepared by cutting back an appropriate length of braid 15 and outer insulative sleeve 16 to expose the separate wires 11 and 12 and their insulating sleeves 11',12'. It is also assumed that the back shell body parts are slipped over the outer insulative sleeve 16. The wires 11 and 12 are then connected to the pins or sockets of the main connector portion 21 in any suitable manner e.g. by being soldered. The main back shell body part 25 is then slipped down the cable 10 and fitted over the back of the main connector portion 21 and electrically connected thereto in some convenient manner e.g by the use of silver loaded Araldite 28, which serves both to make the electrical connection and to seal the joint between the back shell part 25 and the main connector portion 21. This sub-assembly of main back shell part 25 and main connector portion 21 forms a cup-shape which can then be filled with an insulative material such as an epoxy to provide good mechanical and insulative properties for the connection between the wires and the pins or sockets of the main connector part. As is known, the insulative filling material is relatively viscous and this results in a pronounced meniscus near the open end 25*a* of the main body portion 25. It may be necessary to remove some of the insulative material from the interior wall of the neck 25*a* so as to expose the metal of the interior wall. This may be necessary in view of the fact that the next step is that the metal screening braid 15 is spread out over the top of the insulative material 29 and into contact with the wall of the main back shell part 25 as is more clearly shown in FIG. 2.

The further back shell part 26 is then slipped down the exterior of the cable 10 to mate with the main back shell part 25 and be electrically connected thereto by means of any suitable mechanical arrangement or by being bonded thereto using for example silver loaded Araldite. Also, the braid of the cable is attached to the wall of the back shell either by being trapped between the mating surfaces of the main back shell part 25 and the further back shell part 26 and/or by virtue of a predetermined amount of conductive bonding material e.g. silver loaded Araldite being loaded into the end of the further back shell body portion 26 so that a conductive path extends over a predetermined axial length of the back shell. Once the Araldite has cured, the remaining internal space of the further back shell body portion can be filled with an insulative material so as to seal the end of the cable.

Allternatively, or additionally, an insulative sleeve can be provided over the top of the end of the further body portion 26, but this is not shown in the drawings.

Figure 3A:
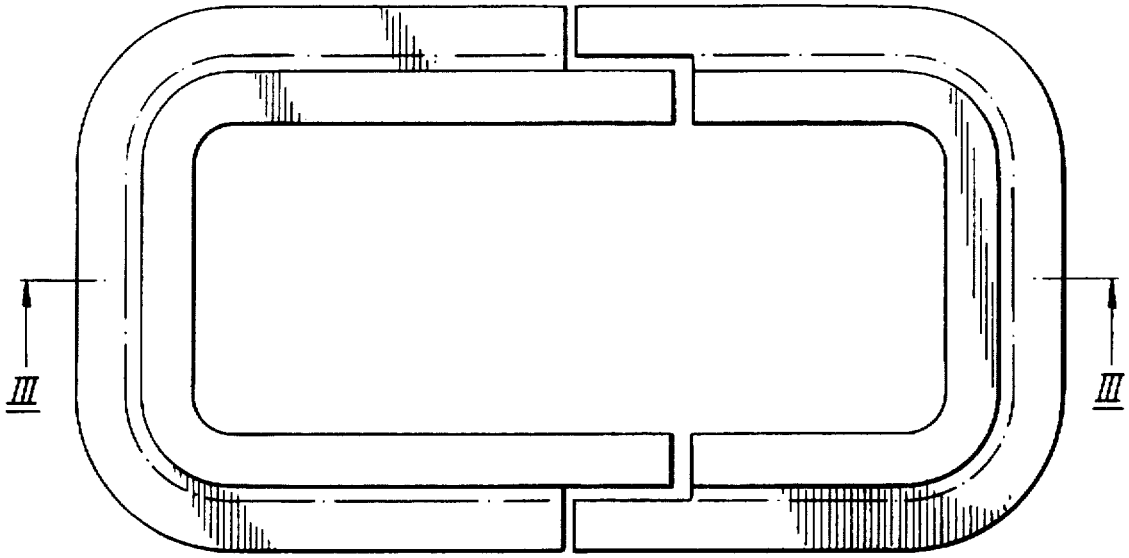
FIG. 3A is an end view of a modification of a back shell of the present invention.
Figure 3B:
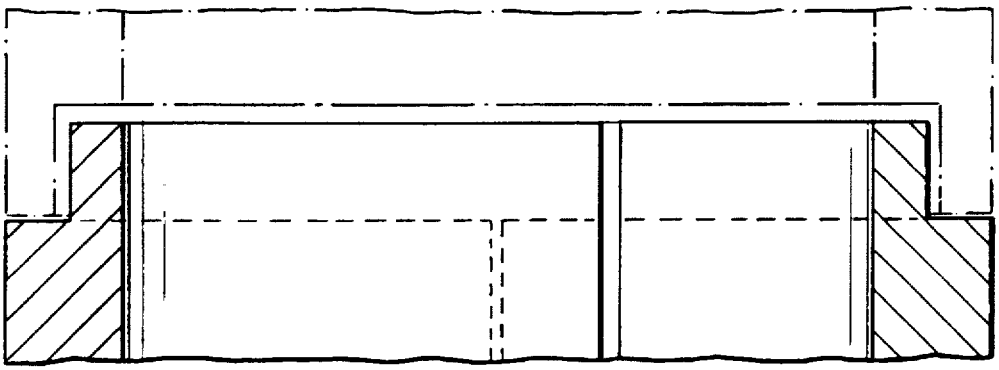
FIG. 3B is a fragmentary side sectional elevation of the arrangement of FIG. 3A.

Depending on the amount of space available for making connections between the wires and the pins or sockets of the main connector part, it may be necessary to modify the main back shell body part 25 to make it in two-part form so that there is no necessity for the main body part to be slipped over the end of the cable. In other words, the connection between the wires and the pins and sockets of the main connector portion 21 can be made and then the two parts of the main back shell body can be secured from either side of the back of the main connector portion . This type of construction is shown more clearly in FIGS. 3A and 3B where the back shell is shown in end view and fragmentary cross-section respectively. The two portions of the back shell will be conductively bonded together and it is envisaged that a tubular further back shell portion similar to the back shell portion 26 shown in FIG. 1 will be slipped over the assembled main back shell portions to provide further mechanical security as well as being bonded thereto.

Figure 4A:
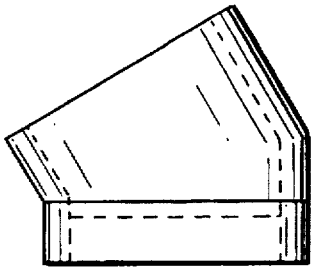
FIGS. 4A-4C show respective side, front and top views of a further modification of a back shell according to the present invention.
Figure 4B:
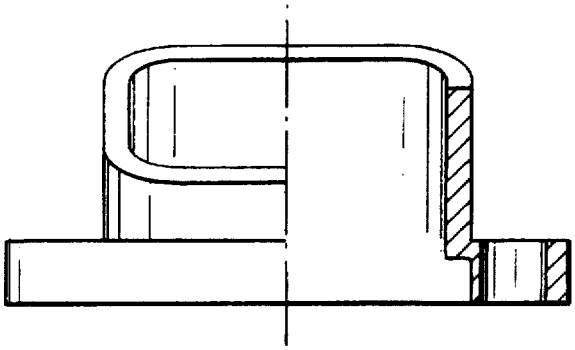
Figure 4C:
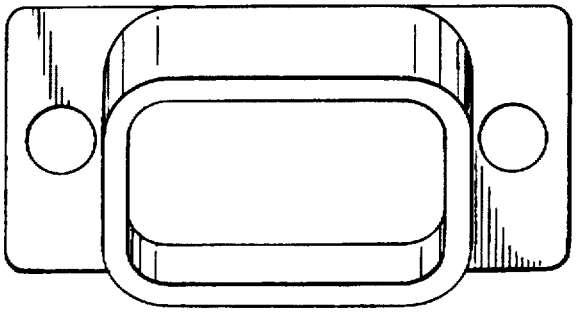

Different shapes of back shell can be made in accordance with the above general description and one such modification is shown in FIGS. 4A-4C which show in respective side, front and to views a main back shell portion having an angled extension piece. This may be in two-part form if necessary and a tubular extension as described above will be provided.

Further modifications may include mechanical seals being provided on the mating face of the main connector part whereby to ensure a good mechanical seal between the connector parts in use. These seals are usually elastomeric O-rings.

I claim:

1. A method for constructing an electrical connector comprising the steps of:

attaching a cable to a main connector part;

attaching a back shell to said main connector part, said back shell accommodating said cable, whereby the connection between said main connector part and said cable is enclosed by said back shell, and conductively linking a conductive braiding on said cable to an internal surface of said back shell, said back shell comprising a first portion attached to said main connector part and a second portion surrounding the cable, said second portion of said back shell being conductively bonded to said first portion, and said braiding being conductively bonded to the back shell close to where the first and second portions of the back shell are conductively bonded using an electrically conductive epoxy resin material.

2. A method according to claim 1, wherein said first portion of said back shell is attached and conductively bonded to said main connector part before said second portion of said back shell is conductively bonded to said first portion of said back shell.

3. A method according to claim 1, wherein a volume defined by said main connector part and said first portion of said back shell is filled with an electrically insulating resin prior to the bonding of the braid to the first back shell portion.

4. A method according to claim 3, wherein the volume defined by said main connector part and said first portion of said back shell is filled with electrically insulating resin prior to said second portion of said back shell being conductively connected to said first portion of said back shell.

5. A method according to claim 3, wherein said braiding of one or more cables is spread out over the surface of the electrically insulating resin prior to being conductively bonded to said first portion of said back shell to form an EMC screen shield.

6. Electrical connector apparatus comprising:

a cable attached to a main connector part;

a back shell attached to said main connector part arranged to enclose the connection between said main connector part and said cable, said back shell comprising a first portion attached to said main connector part and a second portion surrounding said cable, said first and second portions being joined at a junction therebetween, and braiding surrounding said cable being conductively bonded to an internal surface of said back shell close to the junction of said first and second portions using electrically conductive epoxy resin material.

7. Electrical connector apparatus according to claim 6, wherein the volume defined by the main connector part and said back shell is filled with electrically insulating resin.

8. Electrical connector apparatus according to claim 7, wherein said braiding is spread out over the surface of the resin.

9. Electrical connector apparatus according to claim 6, wherein said first portion of said back shell may be made up of a plurality of parts which are bonded together using conductive epoxy resin material.

10. An EM shielded electrical connector apparatus for connection to first and second selectable portions of a cable end comprising:

a main connector part having a connection region for receiving the cable end therein for connection to the first selectable portion thereof;

a back shell having an internal surface and being attached to said main connector part for enclosing the connection region, said back shell comprising a first portion attached to said main connector part and a second portion surrounding said cable, said first and second portions having confronting end portions forming a junction therebetween and being conductively linked said first and second portions for receiving the cable end therein and for connection to said second selectable portion of said cable end;

an electrically conductive epoxy resin material locatable in the interior of said backshell for enabling an electrical connection between the second selectable portion of the cable end and said backshell close to the junction of said first and second portions.

11. The electrical connector apparatus according to claim 10, wherein the main connector part and said back shell define an interior volume and an electrically insulating resin fills said volume.

12. The electrical connector apparatus according to claim 11, wherein said second selectable portion of the cable end comprise a braiding spread out over a surface of the resin to form an EM shield thereat.

13. The electrical connector apparatus according to claim 10, wherein said first portion of said back shell comprises a plurality of parts and a conductive epoxy resin material for bonding the parts together.

14. The electrical connector apparatus according to claim 10, wherein the cable has one of a round, flat and non-symmetric cross-section.

15. The electrical connector apparatus according to claim 14, wherein the back shell has an opening sufficiently large to receive a plurality of said cables.

16. The electrical connector apparatus according to claim 12, wherein said EM shield has 360° coverage.

* * * * *